US005250123A

United States Patent [19]

Yashiki et al.

[11] Patent Number: 5,250,123

[45] Date of Patent: Oct. 5, 1993

[54] ORIENTED SILICON STEEL SHEETS AND PRODUCTION PROCESS THEREFOR

[75] Inventors: Hiroyoshi Yashiki, Kobe; Teruo Kaneko, Hyogo, both of Japan

[73] Assignee: Sumitomo Metal Industries, Ltd., Osaka, Japan

[21] Appl. No.: 850,857

[22] Filed: Mar. 13, 1992

[30] Foreign Application Priority Data

Mar. 15, 1991 [JP] Japan ..... 3-051367

[51] Int. Cl.[5] ..... C22C 38/02

[52] U.S. Cl. ..... 148/111; 148/112; 148/113

[58] Field of Search ..... 148/111, 112, 113, 307, 148/308

[56] References Cited

U.S. PATENT DOCUMENTS 4,595,426 6/1986 Iwayama et al. ..... 148/111
5,082,509 1/1992 Ushigami et al. ..... 148/111

FOREIGN PATENT DOCUMENTS 0333221 9/1989 European Pat. Off. ..... 148/111
57-207114 12/1982 Japan .
62-83421 4/1987 Japan .
1-119644 5/1989 Japan .

*Primary Examiner*—R. Dean
*Assistant Examiner*—Sikyin Ip
*Attorney, Agent, or Firm*—Burns, Doane, Swecker & Mathis

[57] ABSTRACT

An oriented silicon steel sheet with a very low core loss and a process for producing it at a lower cost are disclosed. The steel sheet consists essentially of Si: 1.5-3.0%, Mn: 1.0-3.0%, sol. Al: 0.003-0.015%, with Si (%)−0.5×Mn (%)≦2.0 and the balance being Fe and incidental impurities, in which the amount of C and N as impurities is not more than 0.0020%, with S being not more than 0.01%. This steel sheet can be produced from a slab containing up to 0.01% C and 0.001-0.010% N through hot rolling, cold rolling, primary and secondary recrystallization, and then decarburization.

12 Claims, 1 Drawing Sheet

ORIENTED SILICON STEEL SHEETS AND PRODUCTION PROCESS THEREFOR

The present invention relates to grain-oriented magnetic steel sheets or strips, i.e., oriented silicon steel sheets, which are extensively used to make cores in transformers, generators, and motors, and magnetic shields. The present invention also relates to a process for producing such oriented silicon steel sheets.

Oriented silicon steel sheets are soft magnetic materials that have a crystallographic orientation in which the {110}<001> orientation, generally referred to as the Goss orientation, is dominant and that have excellent excitation and core loss characteristics in the rolling direction.

A typical process for producing oriented silicon steel sheets comprises the steps of hot-rolling a slab of steel containing up to 4.0% Si immediately or after annealing the hot-rolled sheet and cold-rolling the sheet one or more times, with an intermediate annealing being conducted between successive stages of cold rolling, to attain a final sheet thickness, thereafter subjecting the sheet to a continuous decarburization annealing to cause primary recrystallization, then applying a parting agent for preventing fusion or seizure, winding the sheet in a coil, and further performing finish annealing at a very high temperature of 1100°-1200° C. The purpose of the finish annealing is two-fold; it is conducted to cause secondary recrystallization, thereby forming a textured structure in which integration in the Goss orientation is dominant and it is also conducted to remove the precipitate, called an "inhibitor", which has been used to cause secondary recrystallization. The step of removing the precipitate is also known as "purification annealing" and may be regarded as an essential step for obtaining satisfactory magnetic characteristics.

Japanese Published Unexamined Patent Application No. 57-207114/1983 discloses a process for producing an oriented silicon steel sheet from a slab containing C: 0.002-0.010%, Si: up to 6%, sol. Al: 0.015-0.07%, N: up to 0.01% and B: 0.003%, in which finish annealing is carried out first in a decomposed ammonia atmosphere and then the atmosphere is changed to a hydrogen atmosphere at 1100° C. and the annealing is continued at 1200° C. for 20 hours.

One major disadvantage of oriented silicon steel sheets produced by the method described above is their extremely high cost since the production process involves special steps such as continuous decarburization annealing and finish annealing at extra-high temperatures of at least 1100° C.

Japanese Published Unexamined Patent Application No. 62-83421/1987 discloses a process for producing an oriented silicon steel sheet from a slab containing C: up to 0.01%, Si: up to 4.0%, sol. Al: 0.003-0.015%, N: 0.0010-0.010%, but working examples thereof employ a rather high content of C and N, i.e., C: not less than 0.003%, N: not less than 0.0032%, and C+N is not less than 0.0062%. Finish annealing is carried out in an N, atmosphere at 800° C. or higher, e.g. 850°-890° C. in the working examples.

In this case the production cost is rather low, but the core loss is high, resulting in degradation in magnetic properties.

Various R&D efforts have been made with a view to solving this cost problem. For instance, the present inventors previously developed an oriented silicon steel sheet chiefly characterized by comprising 0.5-2.5% Si, 1.0-2.0% Mn, 0.003-0.015% sol. Al, up to 0.01% C and 0.001-0.010% N, as well as a process for its production that did not need decarburization annealing but which was capable of low-temperature annealing (Japanese Published Unexamined Patent Application No. 1-119644/1989). That process is anticipated to make a great contribution to reducing the cost of oriented silicon steel sheets by omitting the step of continuous decarburization annealing while lowering the temperature for finish annealing.

However, in the above-noted invention, the working examples employ a rather high content of C and N, i.e., C: not less than 0.002%, N: not less than 0.0021%, and C+N: not less than 0.0041%. In addition, final annealing is carried out at 800°-950° C., and first in the $N_2$ atmosphere, and then in the $H_2$ atmosphere at 850°-880° C., as described in the working examples, resulting in a decrease in core loss to 0.82-1.50 W/kg for $W_{15/50}$, i.e., 1.17-2.15 W/kg for $W_{17/50}$.

SUMMARY OF THE INVENTION

As there has been an ever growing social demand for energy conservation, a strong impetus has been given today to reduce the core loss of oriented silicon steel sheets.

An object of the present invention is to provide an oriented silicon steel sheet and a process for its production, the sheet having properties superior to those described in Japanese Published Unexamined Patent Application No. 1-119644/1989, described above.

Another object of the present invention is to provide an oriented silicon steel sheet with a very low core loss, as well as a process for producing it.

The present invention is an oriented silicon steel sheet which consists essentially, on a weight basis, of 1.5-3.0% Si, 1.0-3.0% Mn, 0.003-0.015% of sol. Al, with Si (%) $-0.5\times$Mn (%)$<2.0$ and a balance of Fe and incidental impurities, in which the sum of C and N as impurities is not more than 0.0020% with S being not more than 0.01%.

In another aspect, the present invention is a process for producing an oriented silicon steel sheet, in which a slab that consists essentially, on a weight bases, of up to 0.01% C, 1.5-3.0% Si, 1.0-3.0% Mn, up to 0.01% S, 0.003-0.015% of sol. Al and 0.001-0.010% N, with Si (%)$-0.5\times$Mn (%)$\leqq 2.0$ and a balance of Fe and incidental impurities is treated by the following steps (i)-(v):

(i) a hot-rolling step;

(ii) a step in which the sheet, as hot-rolled or after being subsequently annealed, is cold-rolled one or more times with an intermediate annealing performed between successive stages of cold rolling;

(iii) a step of causing primary recrystallization by continuous annealing;

(iv) a step of causing secondary recrystallization by holding the annealed sheet in a temperature range of 825°-925° C. for 4-100 hours in a nitrogen-containing atmosphere; and (v) a step of holding the sheet in a temperature range beyond 925° C. and up to 1050° C. for 4-100 hours in a hydrogen atmosphere to reduce the amount of C+N to 0.0020% or smaller.

It has been known that a decrease in the content of impurities, such as carbon (C) and nitrogen (N) is effective to suppress core loss. However, the content of C+N is 0.003% at the lowest and it has been thought that the effectiveness of reducing the content of impurities, such as C and N saturates when the content of C+N is reduced to as a low level as 0.004%. Furthermore, since, as shown in the working examples of Japanese Published Unexamined Patent Applications No. 62-83421/1987 and No. 1-119644/1989, a finish annealing is carried out at a temperature of lower than 900° C., and it is impossible to reduce the content of C+N to as low a level as 0.0020%.

It has also been thought that the presence of a relatively high content of sol. Al, e.g., usually 0.02–0.06% is necessary so as to promote the occurrence of secondary recrystallization. In contrast, according to the present invention the sol. Al content is reduced to 0.015% or less. This is because when the sol. Al content is over 0.015% the secondary recrystallization does not occur thoroughly, resulting in a markedly high level of core loss.

Thus, according to the present invention the content of C+N is restricted to not more than 0.0020% and that of sol. Al is restricted to 0.003–0.015% so that a core loss of 1.30 W/kg for $W_{17/50}$, compared with a core loss of 1.45–1.55 W/kg for $W_{17/50}$ which has been attained by using a conventional, oriented silicon steel sheet.

Such an extremely low level of the content of C+N can be first achieved by employing two stage finish annealing in which the first half is carried out in a nitrogen-containing atmosphere so as to promote secondary recrystallization, and the second half is carried out in a hydrogen-containing atmosphere at a temperature of 925°–1050° C. higher than that of the first half, but lower than that of the conventional extra-high temperature finish annealing.

DESCRIPTION OF THE PREFERRED EMBODIMENTS

Figure 1:
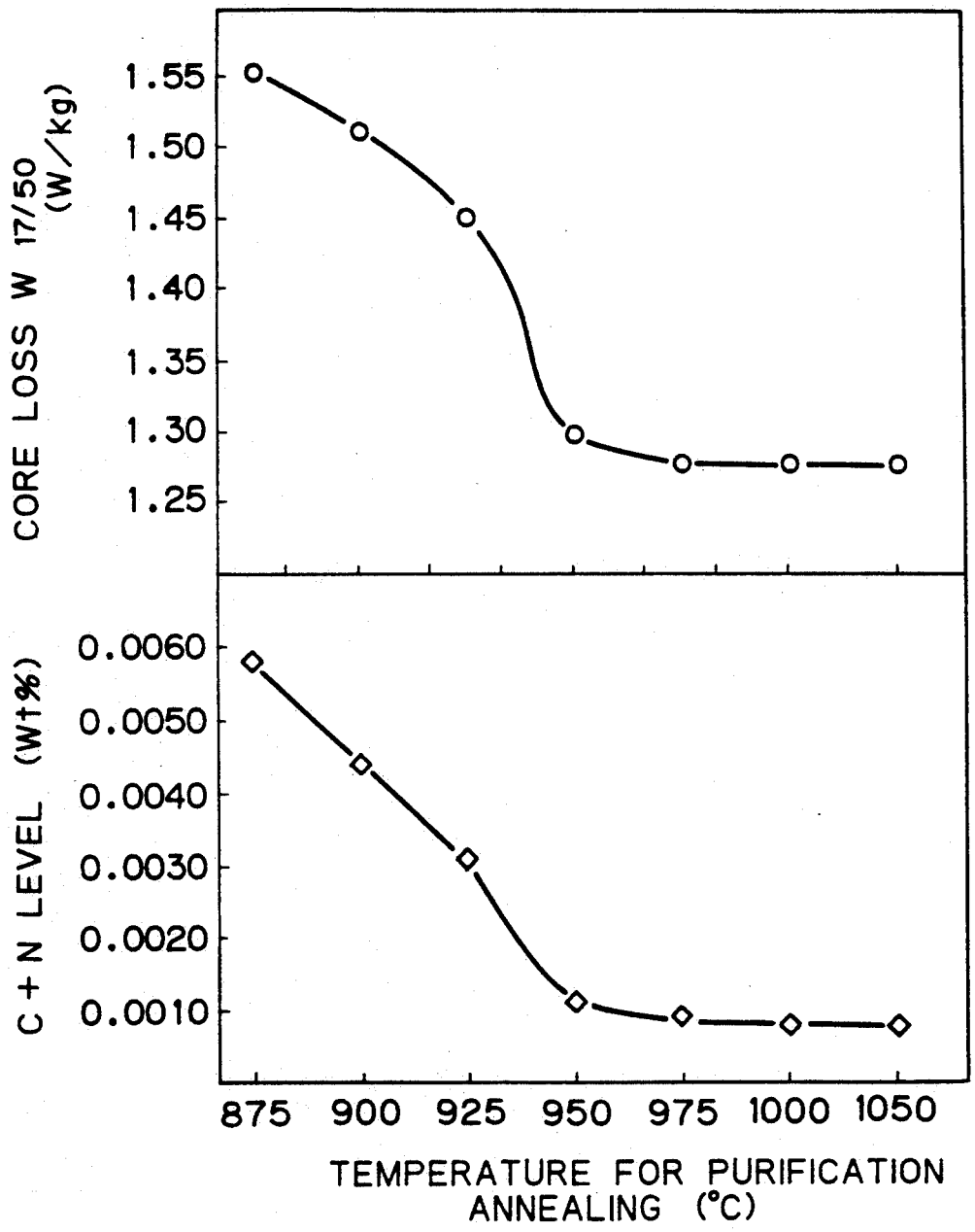
FIG. 1 is a graph showing results of working examples of the present invention.

The results of an experiment on the basis of which the present invention was accomplished will first be described. In the following description of alloy components, all "percentages" are percent by weight unless otherwise indicated.

A steel slab that consisted of 0.0033% C, 2.35% Si, 1.58% Mn, 0.002% S, 0.006% of sol. Al, 0.0045% N, with the balance being Fe and incidental impurities was hot-rolled to a thickness of 2.1 mm and the hot-rolled sheet was annealed at 880° C. for 2 min, followed by pickling to remove scale and further reduction in thickness to 0.35 mm by cold rolling. Thereafter, the sheet was subjected to continuous annealing by soaking at 880° C. for 30 sec. in a non-decarburizing atmosphere so as to cause primary recrystallization. Then, finish annealing was performed by soaking at 880° C. for 24 hours in a 75 vol % $N_2$+25 vol % $H_2$ atmosphere (the first annealing) and subsequent soaking at various temperatures of 875°–1050° C. for 24 hours in an $H_2$ atmosphere (the second annealing). The second annealing conducted at the later stage of the finish annealing is purification annealing intended to remove carbides and nitrides in an $H_2$ atmosphere.

FIG. 1 shows the core loss in the rolling direction and the C+N level in steel that occur after the finish annealing as a function of the temperature for purification annealing. As the FIGURE shows, the core loss decreases appreciably when the temperature for purification annealing exceeds 925° C. The C+N level shows the same tendency as that for the decrease in core loss.

Stated more specifically, the core loss decreases with the decreasing C+N level, and the point at which the C+N level becomes 0.0020% or below coincides with the point at which the core loss substantially levels off at 1.30 W/kg and below. When the total of C and N contents in steel becomes 0.0020% or below, the precipitation of carbides and nitrides, which obstruct domain-wall mobility, will decrease appreciably, which would probably be the cause of the occurrence of such a peculiar phenomenon as described above.

It has heretofore been known that decreasing the amounts of precipitates in steel by purification annealing is effective for decreasing the core loss, but it has not been established that when the total of C and N levels is reduced to 0.0020% and below, the core loss decreases dramatically as shown in FIG. 1. The present invention was accomplished on the basis of this new finding.

It was also verified that performing purification annealing in an $H_2$ atmosphere at the later stage of the finish annealing at temperatures exceeding 925° C. (but not higher than 1050° C.) is effective for the purpose of obtaining products that have extremely low levels of total C and N contents as described above. However, in order to cause secondary recrystallization, a heat treatment should be conducted in the first half period of the finish annealing by holding the steel sheet in the temperature range of 825°–925° C. in a nitrogen-containing atmosphere.

The mechanism of action of the present invention and its advantages are described below as they relate to the respective constitutional elements of the invention.

(a) C and N

As already mentioned above, the C and N levels of the product steel cause adverse effects on core losses and are reduced to 0.0020% or below in terms of the C+N level. This is because the residual C and N that are left in the product will form carbides and nitrides, which obstruct domain-wall mobility and lead to an increased core loss. Such adverse effects of C and N become very small if the C+N level decreases to 0.0020% or below, particularly if it is 0.0015% or below, as shown in FIG. 1.

However, at the stage of the starting steel slab, it is only necessary to reduce the C content to 0.01% or below and such a reduction in the C content will not cause any adverse effects on the occurrence of secondary recrystallization in the finish annealing, even if decarburization annealing is not conducted after the last cold rolling. In addition, the C content can be reduced to a desired low level when purification annealing is carried out in the late stages of the finish annealing. Hence, it is desirable that the C content of the starting steel slab be not more than 0.01%.

Nitrogen (N) is necessary for forming inhibitor nitrides and should be present until after secondary recrystallization is completed. If the N content is less than 0.001% in the starting steel slab, the precipitation of nitrides is too small to provide the desired inhibitor effect. On the other hand, the effectiveness of N is saturated even if it is contained in an amount exceeding 0.010%. Hence, the range of 0.001–0.010% is preferable for the N content. This N content can also be reduced to a desired low level during the purification annealing in such a way that the C+N level is suppressed to 0.0020% or below.

(b) Si

Silicon (Si) causes substantial effects on magnetic characteristics. The higher its content, the higher the electric resistance of the steel sheet, and the lower the eddy-current loss, leading to a smaller core loss. However, if the Si content exceeds 3%, not only does the secondary recrystallization become unstable, but also the workability of the steel sheet decreases to make subsequent cold rolling difficult to achieve. On the other hand, if the Si content is less than 1.5%, the electric resistance of the steel sheet is too low to reduce the core loss. Therefore, the Si content is preferably within the range of 1.5–3.0%.

(c) Mn

Manganese (Mn) is effective at causing $\alpha-\gamma$ transformation in the slabs of high Si and extra-low carbon steels such as the steel of the present invention. The development of that transformation promotes the refining and homogenization of the structure of the sheet being hot rolled. As a result, secondary recrystallization characterized by a higher degree of integration in the Goss orientation will occur in a stable way in the finish annealing.

The development of $\alpha-\gamma$ transformation is determined by the balance between the content of Si, which is a ferrite-forming element, and Mn, which is an austenite-forming element. Hence, a suitable content of each of Si and Mn is determined by the content of the other. In the present invention, Mn is contained in such an amount as to satisfy the condition Si (%)$-0.5\times$Mn (%)$\leqq 2.0$. This is necessary for causing the appropriate transformation in the hot-rolled sheet. In the case where Si is contained in an amount of 3%, which is the upper limit of the range specified by the present invention, at least 2.0% of Mn is necessary in order to satisfy the condition set forth above. Even with materials containing less than 2.0% of Si, the presence of at least 1.0% Mn is effective at stabilizing the secondary recrystallization. Like Si, Mn is also effective at increasing the electric resistance of steel sheets. The presence of at least 1.0% Mn is necessary for the additional purpose of reducing the core loss. However, Mn present in an amount exceeding 3.0% will deteriorate the cold workability of the steel sheet, so the upper limit of the Mn content is set at 3.0%. Thus, the Mn content is in the range of 1.0–3.0% and satisfies the condition Si (%)$-0.5\times$Mn (%)$\leqq 2.0$.

(d) S

Sulfur (S) combines with Mn to form MnS. In the present invention, AlN, (Al,Si)N, and Mn containing nitrides are used as principal inhibitors. In other words, MnS which is used in ordinary oriented silicon steel sheets is not used as a principal inhibitor in the present invention. Hence, there is no need to add S in large amounts. If large amounts of MnS grains remain in the product steel, its core loss characteristics will deteriorate. Further, the temperature for finish annealing is not higher than 1050° C in the present invention, so one cannot expect a desulfurizing effect to occur in the step of purification annealing. Under the circumstances, the S content is controlled to be no more than 0.010% whether it is in the product or the starting steel slab. For reducing the core loss, the S content is preferably 0.005% or below, and more preferably 0.002% or below.

(e) Sol. Al

Aluminum (Al) is an important element that forms nitrides such as AlN and (Al,Si)N, which are principal inhibitors playing an important role in the development of secondary recrystallization. If the Al content is less than 0.003% in terms of sol. Al, the inhibitor effect will be inadequate. However, if the amount of sol. Al exceeds 0.015%, not only does the inhibitor level become excessive but it is also dispersed inappropriately, making it impossible to cause secondary recrystallization in a stable way, and magnetic properties such as core loss will degrade even in the case where the content of C+N is below 0.0020%.

(f) First Step (Hot Rolling)

The starting steel slab has the composition specified in the preceding paragraphs. It may be a slab produced by continuous casting of a molten steel that is prepared in a converter, an electric furnace, etc. and that is optionally subjected to any necessary treatment such as vacuum degassing, or it may be produced by blooming an ingot of that molten steel. The conditions for hot rolling are not limited in any particular way but preferably the heating temperature is 1150°–1270° C. and the finishing temperature is 700°–900° C.

(g) Second Step (Cold Rolling)

The hot-rolled steel sheet is cold-rolled either once or a plurality of times to achieve a predetermined thickness of the product sheet. In this case, annealing (generally referred to as "hot-rolled sheet annealing") may be done prior to the start of cold rolling. This step of hot-rolled sheet annealing promotes the optimization of the state of dispersion of precipitates and the homogenization of the microstructure of the hot-rolled sheet due to recrystallization and, hence, is effective at stabilizing the development of secondary recrystallization during finish annealing.

If hot-rolled sheet annealing is to be accomplished by continuous annealing, soaking is preferably conducted at 750°–1100° C. for 10 sec. to 5 min.; if it is to be performed by box annealing, soaking is preferably conducted at 650°–950° C. for 30 min. to 24 hours.

If cold rolling is to be performed a plurality of times, an intermediate annealing step is provided between successive passes of cold rolling. This intermediate annealing is preferably conducted at a temperature of 700°–950° C. In order to attain a satisfactory structure of primary recrystallization by continuous annealing, the reduction in thickness to be achieved upon completion of the cold rolling is preferable 40–90%, with even better results being effectively attained by a reduction of 70–90%.

(h) Third Step (Continuous Annealing Before Finish Annealing—Primary Recrystallization Annealing)

In order to insure that stable secondary recrystallization will occur in the finish annealing to be described below, primary recrystallization to be performed by rapid heating is necessary. To this end, continuous annealing is effective. The annealing temperature is preferably 700°–950° C.

(i) Fourth Step (First Annealing in the Process of Finish Annealing—Secondary Recrystallization Annealing)

Finish annealing consists of annealing (first annealing) in the first half period which is intended to develop secondary recrystallization and subsequent annealing (second annealing) which is intended to remove precipitates (purification).

To develop secondary recrystallization, annealing in a nitrogen-containing atmosphere is necessary. This is for preventing the occurrence of unstable secondary recrystallization due to the decrease in inhibitor nitrides upon denitration. A positive reason for this practice is in order to increase the precipitation of inhibitor nitrides by nitrogen absorption from the annealing atmosphere so as to induce the occurrence of secondary recrystallization that is characterized by a higher degree of integration in the Goss orientation. To meet this need, the content of $N_2$ in the annealing atmosphere is preferably at least 10 vol % (it may be composed of 100 vol % $N_2$),. The non-$N_2$ gaseous component of the annealing atmosphere may be $H_2$ or Ar, with the former being more common.

The effective temperature range for causing secondary recrystallization is 825°-925° C. Below 825° C., the inhibitors used have such a strong power of inhibiting grain growth that secondary recrystallization will not occur. On the other hand, the inhibitor effect is so weak in the temperature range exceeding 925° C. that either secondary recrystallization characterized by a low degree of integration in the Goss orientation will occur, or, alternatively, the normal grains will grow to simply coarsen the grains of primary recrystallization. The temperature in the range of 825°-925° C. must be held for at least 4 hours but holding for more than 100 hours makes no sense and is economically disadvantageous. For these reasons, the first half of the finish annealing process (first annealing) is to be accomplished by holding the steel sheet at 825°-925° C. for 4-100 hours in a nitrogen-containing atmosphere in order to cause secondary recrystallization.

(j) Fifth Step (Second Annealing in the Process of Finish Annealing—Purification Annealing)

Once secondary recrystallization has occurred, the inhibitor nitrides are deleterious to magnetic characteristics and must be removed. This need is met in the fifth step, namely, the step of purification annealing. It is effectively accomplished by annealing in an H, atmosphere while carbon (C), which is similarly deleterious to magnetic characteristics, is also removed. However, one of the major characteristic features of the electrical steel sheet of the present invention is that C+N is no more than 0.0020%, and it is difficult to satisfy this condition by conducting the purification annealing at 925° C. and below. In order to complete denitration and decarburization within a short time and to lower the levels of N and C that are present after purification annealing, annealing is preferably carried out at temperatures exceeding 950° C. However, temperatures exceeding 1050° C. make no sense since the effect of annealing to remove C and N is saturated. The temperature for purification annealing must be held for at least 4 hours but holding for more than 100 hours is unnecessary. Therefore, the second half of the finish annealing process (second annealing) is to be accomplished by performing purification annealing in the temperature range exceeding 925° C. but not exceeding 1050° C. for 4-100 hours in an $H_2$ atmosphere.

As in the process for producing conventional oriented silicon steel sheets, a parting agent may be applied before finish annealing so as to prevent seizure that may occur during annealing. Steps to be adopted after finish annealing are also the same as in the case of conventional oriented silicon steel sheets; after removing the parting agent, an insulating coat may be applied or flattening annealing may be carried out as required.

The present invention will be further described in conjunction with the following working examples which are presented merely for illustrative purposes.

EXAMPLE 1

Steel slabs each consisting of 0.0030% C, 2.35% Si, 1.53% Mn, 0.002% S, 0.010% sol. Al and 0.0042% N, with the balance being Fe and incidental impurities were prepared by a process consisting of melting in a converter, compositional adjustment by treatment under vacuum, and continuous casting. The slabs were hot rolled at an elevated temperature of 1240° C. and finished to a thickness of 2.0 mm at 820° C.

Subsequently, the hot-rolled sheets were annealed by soaking at 880° C. for 40 sec, descaled by pickling, and cold rolled to a thickness of 0.30 mm by one stage of rolling. The cold rolled sheet was subjected to continuous annealing by soaking in a 78 vol % $N_2$+22 vol % $H_2$ non-decarburizing atmosphere at 880° C. for 30 sec to cause primary recrystallization. Thereafter, a parting agent was applied and a finish annealing was conducted. The finish annealing process consisted of the first annealing that comprised soaking in a 75 vol % $N_2$+25 vol % H, atmosphere at 885° C. for 24 hours, shifting to an $H_2$ atmosphere and the second annealing that comprised soaking for 24 hours at the various temperatures listed in Table 1 below. The C+N levels of the thus obtained steel sheets and their magnetic characteristics in the rolling direction are also shown in Table 1.

As is clear from Table 1, steel sheet (product) Run Nos. 4-7 which were treated under appropriate conditions for finish annealing and which had C+N levels controlled to 0.0020% and below had very low core losses while having higher levels of magnetic flux density ($B_8$).

EXAMPLE 2

Three steel species having substantially the same composition within the ranges specified by the present invention except that the amount of sol. Al was varied significantly at three different levels (see Table 2) were melted by the same method as in Example 1 to obtain slabs, which were then hot-rolled under the same conditions as in Example 1 and each finished to a thickness of 2.3 mm. The thus hot-rolled sheets were descaled by pickling and subjected to box annealing by soaking at 800° C. for 2 hours. Subsequently, each of the annealed sheets was cold-rolled to a thickness of 0.35 mm by one stage of rolling.

Each of the cold-rolled sheets was subjected to continuous annealing by soaking in a 25 vol % $N_2$+75 vol % $H_2$ non-decarburizing atmosphere at 875° C. for 30 sec so as to cause primary recrystallization, followed by application of a parting agent and a finish annealing. The finish annealing process consisted of soaking in a 75 vol % $N_2$+25 vol % $H_2$ atmosphere at 875° C. for 24 hours, shifting to an $H_2$ atmosphere, and purification annealing by soaking at 950° C. for 24 hours. The C+N levels of the thus obtained steel sheets and their magnetic characteristics in the rolling direction are shown in Table 3 below.

Run No. 1 having a smaller amount of sol. Al than specified by the present invention had a C+N level not higher than 0.0020%; however, on account of the weak inhibitor effect, secondary recrystallization characterized by integration in the Goss orientation could not be obtained and the magnetic flux density ($B_8$) was too low to exhibit satisfactory magnetic characteristics. Run No. 3 having a greater amount of sol. Al than specified by the present invention also had a high N content and no secondary recrystallization was found to have occurred; hence, Run No. 3 was very poor in both aspects of core loss and magnetic flux density. In contrast, Run No. 2 corresponding to an example of the electrical steel sheet of the present invention exhibited excellent magnetic characteristics.

EXAMPLE 3

Steel slabs each consisting of 0.0050% C, 2.62% Si, 1.85% Mn, 0.0006% S, 0.007% sol. Al and 0.0035% N, with the balance being Fe and incidental impurities, were prepared by the same method as in Example 1. The slabs were hot rolled under the same conditions as in Example 1 and finished to a thickness of 1.8 mm. These hot rolled sheets were annealed by soaking at 880° C. for 1 min, descaled by pickling, and cold rolled to a thickness of 0.27 mm by one stage of rolling.

Subsequently, the cold rolled sheets were subjected to continuous annealing by soaking in a 50 vol % $N_2$+50 vol % $H_2$ non-decarburizing atmosphere at 875° C. for 30 sec. to cause primary recrystallization. Thereafter, a parting agent was applied and finish annealing was conducted.

The finish annealing was conducted under the two different conditions set forth in Table 4 below. The finish annealing process consisted of the first annealing that comprised soaking in a 50 vol % $N_2$+50 vol % $H_2$ atmosphere which was intended to achieve secondary recrystallization and the second annealing in an $H_2$ atmosphere which was intended to achieve purification annealing. The temperatures for soaking in the first and second annealings were combined in various ways as shown in Table 4. The C+N levels of the thus obtained steel sheets and their magnetic characteristics in the rolling direction are shown in Table 5.

Run No. 2, which was subjected to the second annealing at a lower soaking temperature than specified by the present invention, experienced secondary recrystallization, but since the C+N level was higher than the upper limit value specified by the present invention, no satisfactory magnetic characteristics could be attained. In contrast, Run No. 1 corresponding to an example of the present invention had a very low core loss while having a higher level of magnetic flux density.

EXAMPLE 4

Steel slabs having the steel compositions shown in Table 6 were prepared and processed as in Example 1 except that the soaking of the hot rolled sheet was carried out at 900° C. for 1 minute, and the hot rolled sheet was descaled by pickling and cold rolled to a thickness of 0.30 mm by one stage of rolling. The cold rolled sheet was subjected to continuous annealing by soaking in a 25 vol % $N_2$+75 vol % $H_2$ non-decarburizing atmosphere at 880° C. for 30 sec. to cause primary recrystallization. Thereafter, a parting agent was applied and finish annealing was conducted. The finish annealing process consisted of the first annealing that comprised soaking in a 25 vol % $N_2$+75 vol % $H_2$ atmosphere at 880° C. for 24 hours, shifting to an H, atmosphere and the second annealing that comprised soaking for 24 hours at 950° C. The C+N levels of the thus-obtained steel sheets and their magnetic characteristics in the rolling direction are also shown in Table 7.

As Table 7 shows, steel sheet (product) Run No. 1 in which steel composition did not satisfy the equation $Si(\%)-0.5\times Mn(\%)\leqq 2.0\%$ suffered from a very high core loss while having a lower level of magnetic flux density ($B_8$). In contrast, steel sheet run No. 2 which corresponds to the product of the present invention had a very low core loss while having a high level of magnetic flux density.

TABLE 1

| Run No. | Temperature for 2nd annealing (°C.) | C and N levels, core loss and flux density of product: C (%) | N (%) | C + N (%) | $W_{17/50}$ (W/kg) | $B_8$ (T) | Remarks |
|---|---|---|---|---|---|---|---|
| 1 | 880 | 0.0021 | 0.0040 | 0.0061 | 1.35 | 1.83 | X |
| 2 | 900 | 0.0013 | 0.0034 | 0.0047 | 1.30 | 1.84 | X |
| 3 | 920 | 0.0010 | 0.0023 | 0.0033 | 1.25 | 1.84 | X |
| 4 | 940 | 0.0006 | 0.0009 | 0.0015 | 1.13 | 1.86 | ○ |
| 5 | 960 | 0.0006 | 0.0008 | 0.0014 | 1.10 | 1.86 | ○ |
| 6 | 980 | 0.0003 | 0.0007 | 0.0010 | 1.08 | 1.87 | ○ |
| 7 | 1000 | 0.0003 | 0.0006 | 0.0009 | 1.08 | 1.87 | ○ |

Note:
X: Comparative
○: Present Invention

TABLE 2

| Run No. | Composition of steel slab (wt %): C | Si | Mn | S | sol. Al | N | Bal. |
|---|---|---|---|---|---|---|---|
| 1 | 0.0025 | 2.11 | 1.40 | 0.003 | 0.002 | 0.0037 | Substantially Fe and incidental impurities |
| 2 | 0.0027 | 2.10 | 1.40 | 0.003 | 0.006 | 0.0035 | |
| 3 | 0.0029 | 2.10 | 1.39 | 0.003 | 0.021 | 0.0033 | |

TABLE 3

| Run No. | C and N levels, core loss and flux density of product: C (%) | N (%) | C + N (%) | $W_{17/50}$ (W/kg) | $B_8$ (T) | Remarks |
|---|---|---|---|---|---|---|
| 1 | 0.0005 | 0.0007 | 0.0012 | 2.40 | 1.61 | X |
| 2 | 0.0005 | 0.0008 | 0.0013 | 1.30 | 1.85 | ○ |
| 3 | 0.0006 | 0.0030 | 0.0036 | 4.15 | 1.54 | X |

TABLE 4

| Run No. | Soaking condition for 1st annealing | Soaking condition for 2nd annealing |
|---|---|---|
| 1 | 890° C. × 24 h | 960° C. × 24 h |
| 2 | 890° C. × 24 h | 890° C. × 24 h |

TABLE 5

| Run No. | C and N levels, core loss and flux density of product: C (%) | N (%) | C + N (%) | $W_{17/50}$ (W/kg) | $B_8$ (T) | Remarks |
|---|---|---|---|---|---|---|
| 1 | 0.0004 | 0.0008 | 0.0012 | 1.03 | 1.86 | ○ |
| 2 | 0.0015 | 0.0030 | 0.0045 | 1.23 | 1.84 | X |

Note:
X: Comparative
○: Present Invention

TABLE 6

| Run No. | Composition of steel slab (wt %) C | Si | Mn | sol. Al | N | S (%) −0.5 × Mn (%) ≦ 2.0 |
|---|---|---|---|---|---|---|
| 1 | 0.0045 | 2.70 | 1.05 | 0.009 | 0.0047 | 2.12 |
| 2 | 0.0044 | 2.72 | 2.66 | 0.009 | 0.0045 | 1.39 |

TABLE 7

| Run No. | C and N levels, core loss and flux density of product C (%) | N (%) | C + N (%) | $W_{17/50}$ (W/kg) | $B_8$ (T) | Remarks |
|---|---|---|---|---|---|---|
| 1 | 0.0006 | 0.0006 | 0.0012 | 2.35 | 1.66 | X |
| 2 | 0.0006 | 0.0010 | 0.0016 | 1.05 | 1.80 | ○ |

Note:
X: Comparative
○: Present Invention

As demonstrated in the examples, the oriented silicon steel sheet of the present invention has a very small core loss and can advantageously be used to make cores in transformers, generators and motors, and magnetic shields. According to the present invention a 10% improvement in terms of core loss can be attained. In Japan this means a saving of about five hundreds million kWh of electrical energy a year. This is tremendously advantageous from practical viewpoint.

Furthermore, such an electrical steel sheet can be easily produced by the process of the present invention. Since this process includes neither a decarburization annealing step which takes a prolonged time nor a finish annealing step which is conducted at an extra-high temperature of 1150°-1200° C., it is also advantageous from the viewpoint of lower manufacturing costs.

I claim:

1. A process for producing a grain-oriented magnetic steel sheet, in which a slab which consists essentially of, on a weight basis, C: not more than 0.01% C, Si: 1.5-3.0%, Mn: 1.0-3.0%, S: not more than 0.01%, sol.Al: 0.003-0.015% and 0.001-0.010% N, and Si (%) −0.5×Mn (%)≦2.0, the balance being Fe and incidental impurities is processed by the following steps (i)-(v):

(i) a hot-rolling step to obtain a hot-rolled steel sheet through hot rolling of said slab;

(ii) a cold-rolling step in which the sheet, as hot-rolled or after being subsequently annealed, is cold-rolled one or more times with an intermediate annealing performed between successive stages of cold rolling to prepare a cold-rolled sheet;

(iii) a step of causing primary recrystallization by continuous annealing the cold-rolled sheet;

(iv) a step of causing secondary recrystallization by holding the annealed sheet in a temperature range of 825°-925° C. for 4-100 hours in a nitrogen-containing atmosphere; and (v) a step of holding the secondary-recrystallized sheet in a temperature range beyond 925° C. and up to 1050° C. for 4-100 hours in a hydrogen-containing atmosphere to reduce the amount of C+N to 0.0020% or smaller.

2. A process for producing a grain-oriented magnetic steel sheet as set forth in claim 1 wherein the hot rolling step is carried out with a heating temperature of 1150°-1270° C. and a finishing temperature of 700°-900° C.

3. A process for producing a grain-oriented magnetic steel sheet as set forth in claim 1 wherein the continuous annealing step is carried out at a temperature of 700°-950° C.

4. A process for producing a grain-oriented magnetic steel sheet as set forth in claim 1 wherein the nitrogen-containing atmosphere of the step to effect the secondary recrystallization contains 10 vol. % or more of nitrogen gas.

5. A process for producing a grain-oriented magnetic steel sheet as set forth in claim 1 wherein the hydrogen-containing atmosphere of step (v) contains 10 vol. % or more of hydrogen gas.

6. A process for producing a grain-oriented magnetic steel sheet as set forth in claim 1 wherein prior to applying cold rolling a continuous annealing treatment is effected at 750°-1100° C. for 10 seconds to 5 minutes on the hot-rolled sheet.

7. A process for producing a grain-oriented magnetic steel sheet as set forth in claim 1 wherein prior to applying cold rolling a box annealing treatment is effected at 650°-950° C. for 30 minutes to 24 hours on the hot-rolled sheet.

8. A process for producing a grain-oriented magnetic steel sheet as set forth in claim 1 wherein step (iv) is carried out isothermally.

9. A process for producing a grain-oriented magnetic steel sheet as set forth in claim 1 wherein step (v) is carried out isothermally.

10. A process for producing a grain-oriented magnetic steel sheet as set forth in claim 1 wherein the nitrogen-containing atmosphere consists essentially of hydrogen or argon and at least 10% by volume nitrogen.

11. A process for producing a grain-oriented magnetic steel sheet as set forth in claim 1 wherein the nitrogen-containing atmosphere consists essentially of nitrogen.

12. A process for producing a grain-oriented magnetic steel sheet as set forth in claim 1 wherein step (v) is performed at a temperature of at least 950° C.

* * * * *